US010553162B2

(12) United States Patent
Lu et al.

(10) Patent No.: US 10,553,162 B2
(45) Date of Patent: Feb. 4, 2020

(54) GRAYSCALE COMPENSATING METHOD AND APPARATUS FOR SELF-LUMINOUS DISPLAY, AND SELF-LUMINOUS DISPLAY DEVICE

(71) Applicants: QINGDAO HISENSE ELECTRONICS CO., LTD., Qingdao (CN); HISENSE INTERNATIONAL CO., LTD., Qingdao (CN); HISENSE USA CORPORATION, Suwanee, GA (US)

(72) Inventors: Lin Lu, Qingdao (CN); Jianwei Cao, Qingdao (CN)

(73) Assignees: QINGDAO HISENSE ELECTRONICS CO., LTD., Shandong (CN); HISENSE INTERNATIONAL CO., LTD., Shandong (CN); HISENSE USA CORPORATIONGA (US)

( * ) Notice: Subject to any disclaimer, the term of this patent is extended or adjusted under 35 U.S.C. 154(b) by 39 days.

(21) Appl. No.: 15/890,299

(22) Filed: Feb. 6, 2018

(65) Prior Publication Data

US 2018/0211603 A1 Jul. 26, 2018

Related U.S. Application Data

(63) Continuation of application No. PCT/CN2016/074375, filed on Feb. 23, 2016.

(30) Foreign Application Priority Data

Aug. 6, 2015 (CN) ..... 2015 1 0477623

(51) Int. Cl.
*G09G 3/3258* (2016.01)
*G09G 3/3241* (2016.01)

(52) U.S. Cl.
CPC ..... *G09G 3/3258* (2013.01); *G09G 3/3241* (2013.01); *G09G 2300/0809* (2013.01); *G09G 2320/043* (2013.01)

(58) Field of Classification Search
CPC .. G09G 3/3258; G09G 3/3233; G09G 3/3208; G09G 3/30
(Continued)

(56) References Cited

U.S. PATENT DOCUMENTS

2010/0225630 A1 9/2010 Levey et al. ..... 345/211
2013/0257845 A1 10/2013 Chaji et al. ..... 345/212
(Continued)

FOREIGN PATENT DOCUMENTS

CN 101083057 A 12/2007
CN 101510391 A 8/2009
(Continued)

OTHER PUBLICATIONS

The International Search Report of corresponding InternationaL PCT application No. PCT/CN2016/074375, dated May 27, 2016.
(Continued)

*Primary Examiner* — Yuzhen Shen
(74) *Attorney, Agent, or Firm* — J.C. Patents

(57) ABSTRACT

A grayscale compensating method, an apparatus for a self-luminous display and a self-luminous display device are provided. The method includes: obtaining each driving voltage corresponding to each grayscale signal of the self-luminous display; determining, according to intervals to which each driving voltage belongs, each preset driving function corresponding to each driving voltage; determining each first driving current corresponding to each driving voltage according to each preset driving function; detecting each second driving current of pixel units of the self-luminous display in case of being driven at each driving
(Continued)

voltage; comparing the first driving current with the second driving current, and determining compensating voltages corresponding to each grayscale signal according to each preset driving function, and differences between each first driving current and each second driving current.

3 Claims, 6 Drawing Sheets

(58) Field of Classification Search
USPC ..... 345/82
See application file for complete search history.

(56) References Cited

U.S. PATENT DOCUMENTS

2014/0320475 A1* 10/2014 Shin ..... G09G 3/3275 345/212
2015/0213757 A1 7/2015 Takahama et al.
2017/0098407 A1* 4/2017 Jeong ..... G09G 3/2051

FOREIGN PATENT DOCUMENTS

| | | | |
|---|---|---|---|
| CN | 101903935 | A | 12/2010 |
| CN | 104036719 | A | 9/2014 |
| CN | 104123911 | A | 10/2014 |
| CN | 105096824 | A | 11/2015 |
| CN | 1897093 | A | 1/2017 |
| JP | 2005-221688 | A | 8/2005 |
| JP | 2009-193026 | A | 8/2009 |

OTHER PUBLICATIONS

The extended European Search Report of corresponding European patent application No. 16832070.3-1210/3333838, dated Nov. 29, 2018.

* cited by examiner

GRAYSCALE COMPENSATING METHOD AND APPARATUS FOR SELF-LUMINOUS DISPLAY, AND SELF-LUMINOUS DISPLAY DEVICE

CROSS-REFERENCE TO RELATED APPLICATIONS

This application is a continue examination of International Application No. PCT/CN2016/074375 filed on Feb. 23, 2016, which claims the priority of Chinese Patent Application No. 201510477623.2 filed with the Chinese Patent Office on Aug. 6, 2015, entitled "GRAYSCALE COMPENSATING METHOD AND APPARATUS FOR SELF-LUMINOUS DISPLAY, AND SELF-LUMINOUS DISPLAY DEVICE", both of which are incorporated herein by reference.

TECHNICAL FIELD

The present disclosure relates to the field of display technology, and in particular, to a grayscale compensating method and apparatus for a self-luminous display, and a self-luminous display device.

BACKGROUND

Self-luminous devices due to their fast response speeds, high color gamut, high contrast, large display angles and other advantages, are gradually applied to display products.

At present, the self-luminous display mainly includes: a plasma display panel, an electrophoresis display, a field emission display, a surface-conduction electron-emitter display, an organic light-emitting diode (OLED) display and the like.

FIG. 1 is a driving circuit of OLED pixel units. As shown in FIG. 1, the driving circuit of OLED pixel units includes two transistors and a capacitor. One of the transistors is a switch $T_1$ controlled by a scanning signal $V_{scan}$ outputted by a row driving circuit, for the purpose of controlling an input of a data signal $V_{data}$ on a data line, and the other transistor is the driving transistor $T_2$, which is conductive as being driven by the driving voltage $V_{data}$ to control the OLED to emit light. $C_s$ is a storage capacitor which is configured to maintain the driving voltage applied to the driving transistor $T_2$ during a non-scanning period. The OLED can emit light due to the driving of the current generated by the driving transistor is in a saturated state. When the same grayscale voltage is inputted, different driving threshold voltages of the pixel units may generate different driving currents, thereby resulting in inconsistencies of the driving currents. Since it is difficult to ensure the uniformity of the threshold voltage $V_{th}$ of the pixel unit, therefore, the uniformity of the driving current of the self-emitting display is poor when it is driven at low voltages, that is, at low grayscales. At the same time, since the $V_{th}$ also drifts along with the use of the pixel units, the brightness uniformity of the self-luminous display deteriorates with the aging of the OLED pixel units.

At present, in order to improve the problem that the low grayscale uniformity is getting worse due to the aging of the self-luminous display, the driving circuit design of the self-luminous display includes two parts: a normal driving circuit and a compensating circuit, where the normal driving circuit ensures that a video signal content is normally displayed, and the compensating circuit is configured to detect the condition about the aging of the display, and provide compensations in the driving signal accordingly. In the compensating circuit, a current detection line is shared among each column of pixels to detect the driving current of the pixels. A current comparing circuit is provided at the end of the current detecting line. The $V_{th}$ drift data $\Delta V_{th}$ of the self-luminous display is determined by comparing the current before and after continuous operation of the self-luminous display according to the relationship between the current and the voltage of the self-luminous display:

$$I_{ds}=\beta(V_{data}-V_{th})^{\alpha}$$

Where $\beta$ and $\alpha$ are proportional constants, $I_{ds}$ is the driving current of the self-luminous device, $V_{th}$ is the threshold voltage of the self-luminous device, and $V_{data}$ is the actual driving voltage. From the above equation, it can be seen that when $V_{th}$ is shifted and the $V_{th}$ data is gradually increased, $I_{ds}$ will gradually decrease under the same $V_{data}$ signal voltage. The determined $\Delta V_{th}$ is added to the actual $V_{data}$ signal voltage for compensation, in order to overcome defects such as the non-uniformity of the low grayscales caused by the $V_{th}$ drifting.

However, the inventor has found that although the grayscale compensating method described above can improve the brightness performance of the self-luminous display at high grayscales, however, the uniformity of the self-luminous display at low grayscales has not been effectively improved.

SUMMARY

In one aspect, the present disclosure provides a grayscale compensating method for a self-luminous display, including:

obtaining each driving voltage value corresponding to each grayscale signal of a self-luminous display;

determining, according to intervals to which each driving voltage value belongs, each preset driving function corresponding to each driving voltage value, where each preset driving function is a relational expression between driving voltages and driving currents in each corresponding interval;

determining first driving current values corresponding to each driving voltage value according to each preset driving function;

detecting each second driving current value of pixel units of the self-luminous display in case of being driven at each driving voltage value;

determining each compensating voltage value corresponding to each grayscale signal according to each driving function, differences between each first driving current value and each second driving current value.

In another aspect, the present disclosure provides a grayscale compensating apparatus for a self-luminous display, including:

an obtaining module, configured to obtain each driving voltage value corresponding to each grayscale signal of a self-luminous display;

a determining module, configured to determine, according to intervals to which each driving voltage value belongs, each preset driving function corresponding to each driving voltage value, where each preset driving function is a relational expression between driving voltages and driving currents in each corresponding interval;

the determining module is further configured to determine, according to each preset driving function, first driving current values corresponding to each driving voltage value;

a detecting module, configured to detect each second driving current value of pixel units of the self-luminous display in case of being driven at each driving voltage value;

the determining module is further configured to determine, according to each driving function, differences between each first driving current value and each second driving current value, each compensating voltage value corresponding to each grayscale signal.

In another aspect, the present disclosure provides a self-luminous display device, including: the grayscale compensating apparatus for the self-luminous display described above.

The present disclosure provides a grayscale compensating method and apparatus for a self-luminous display, and a self-luminous display device, each driving voltage corresponding to each grayscale signal of a self-luminous display is obtained at first, and each preset driving function corresponding to each driving voltage is determined according to intervals to which each driving voltage belongs, then, first driving current values corresponding to each driving voltage are determined according to each preset driving function, the first driving currents are compared with each second driving current of the pixel units detected in case of being driven at each driving voltage, and each compensating voltage corresponding to each grayscale signal is determined according to each driving function, the difference between each first driving current and each second driving current. The grayscale compensating method for the self-luminous display utilizes different driving functions for different grayscale signals to determine the compensating voltages according to different operating characteristics when the pixel units are driven by different driving voltages, so that the driving voltage of each grayscale can be better compensated, thereby better realizing brightness and chrominance uniformities of each grayscale of the self-luminous display.

DETAILED DESCRIPTION

To make the objectives, technical solutions, and advantages in the embodiments of the present disclosure clearer, the technical solutions in the embodiments of the present disclosure will be described clearly and completely below with reference to the accompanying drawings in the embodiments of the present disclosure.

In the related art, when compensating grayscales of a self-luminous display, although the brightness performance of the self-luminous display at high grayscales can be improved, however, the uniformity of the self-luminous display at low grayscales has not been effectively improved. Starting from the voltage-current characteristic and the brightness-current characteristic of self-luminous pixel units, according to the characteristics that the current density and the brightness of the self-luminous pixel units both increase slowly with the increase of the driving voltage in case of being driven at low voltages, when the driving voltage is greater than a threshold voltage, the current density will increase rapidly, and the brightness will increase rapidly with the increase of the current density, the present disclosure provides a grayscale compensating method for a self-luminous display which calls different compensation functions and performs voltage compensations according to intervals to which each driving voltage belongs. Comparing with the related art solution where a single function is applied for voltage compensation, the present disclosure improves the problem that the uniformity of each grayscale of the self-luminous display is poor and gets worse with the aging of the self-luminous display.

The self-luminous display in the following embodiments of the present disclosure may be a display in all electronic devices having display functions, such as a television display or a computer display. In order to facilitate the illustration, in the following embodiments of the present disclosure, the self-luminous display is hereinafter, collectively referred to as a television display.

Figure 1:
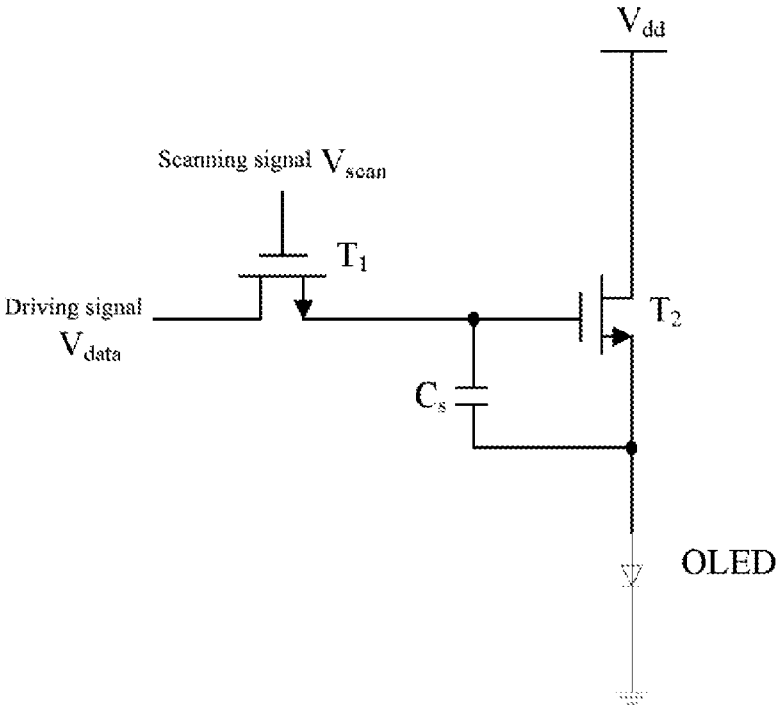
FIG. 1 is a driving circuit of pixel units.
Figure 2:
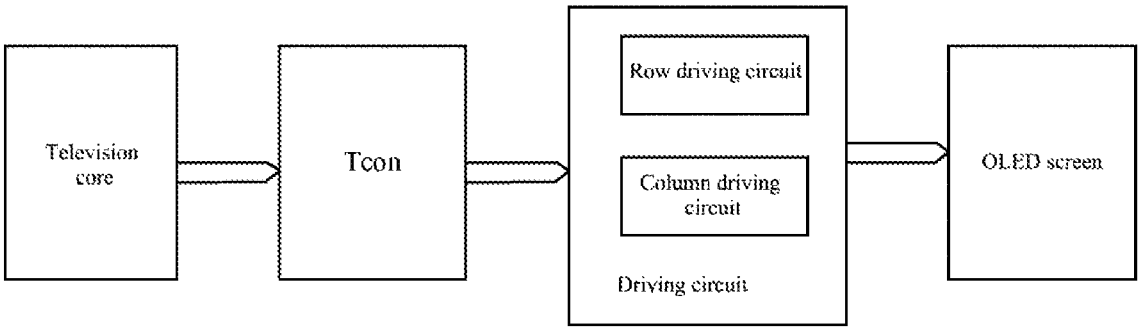
FIG. 2 is a schematic block diagram of a television display system.

To better illustrate the grayscale compensating method and apparatus provided by the present disclosure, firstly, a television is taken as an example to introduce the principle of a television display system. FIG. 2 is a schematic block diagram of the television display system. As shown in FIG. 2, the entire television display system includes a television core, a time controller (Tcon) and a driving circuit, where the driving circuit is further divided into a row driving circuit and a column driving circuit. The television core is mainly composed of a single-chip microcomputer and peripheral circuits, and is configured to generate a variety of control signals for image display; after receiving image information, Tcon generates a corresponding drive signal according to the image information and outputs the generated drive signal to the drive circuit, the drive circuit drives the OLED screen according to the driving signal, thereby displaying the image. The row driving circuit controls the conductance of $T_1$ in FIG. 1 according to the driving signal, and the column driving circuit provides a driving voltage for T2 according to the driving signal, this driving voltage is the driving voltage of the pixel unit in embodiments of the present disclosure, the column driving circuit controls a conduction current of the OLED through controlling a conduction level of T2, so as to control a lighting level of the pixel units, thereby controlling the image displayed on the OLED screen.

Figure 3:
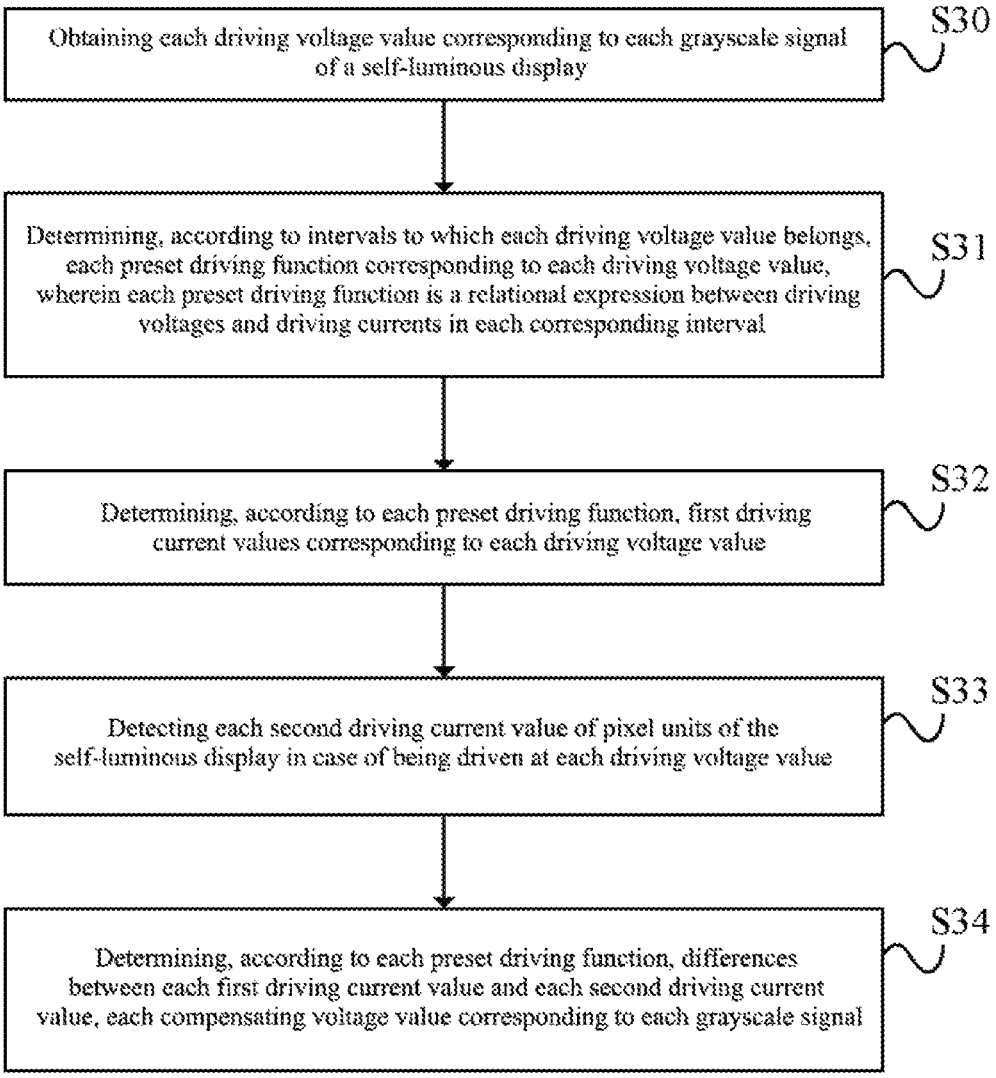
FIG. 3 is a schematic flow chart of a grayscale compensating method for a self-luminous display provided according to some embodiments of the present disclosure.

FIG. 3 is a schematic flow chart of a grayscale compensating method for a self-luminous display provided according to some embodiments of the present disclosure. As shown in FIG. 3, the method includes:

S30, obtaining each driving voltage value corresponding to each grayscale signal of a self-luminous display.

In the present disclosure, the executive subject matter of the grayscale compensating method for the self-luminous display is a grayscale compensating apparatus for the self-luminous display, which is simply referred to as a compensating apparatus collectively hereinafter. In the present disclosure, the compensating apparatus may be arranged between the television core and the Tcon, and may also be arranged between the Tcon and the driving circuit, and may also be integrated in the Tcon or the driving circuit, which is not limited herein. In the present disclosure, the compensation apparatus which is integrated in the Tcon will be described as an example.

Each driving voltage value in the embodiment of the present disclosure is a data signal $V_{data}$ on a data line in the driving circuit of the pixel unit, that is, the driving voltage corresponding to the grayscale signal of the pixel unit.

In terms of the pixel units of the self-luminous display, in an ideal state, different gray-scale signals correspond to different driving voltages. In some embodiment, a mapping relationship table between grayscale signals and driving voltages may be pre-stored in the compensating apparatus. After obtaining each grayscale signal, the compensating apparatus determines each driving voltage value corresponding to each grayscale signal by looking up the mapping relationship table between grayscale signals and driving voltages. Alternatively, the mapping relationship table between grayscale signals and driving voltages may also be stored in the Tcon. After receiving each grayscale signal, the Tcon determines each driving voltage corresponding to each grayscale signal by looking up the mapping relationship table between grayscale signals and driving voltages, and sends each driving voltage value to the compensating apparatus. The present disclosure does not limit this.

It can be understood that the corresponding relationship between grayscale signals and driving voltages can be stored in the compensating apparatus or the Tcon in the form of a curve in addition to in the form of a mapping table as described above. If the compensating apparatus or the Tcon stores a curve of grayscale signals and driving voltages, in the process of the image display, the compensating apparatus or the Tcon can determine the driving voltages corresponding to different grayscale signals by looking up the curve.

S31, determining, according to intervals to which each driving voltage value belongs, each preset driving function corresponding to each driving voltage value, where each preset driving function is the relational expression between driving voltages and driving currents in each corresponding interval.

S32, determining, according to each preset driving function, first driving current values corresponding to each driving voltage value.

It can be seen from the above analysis that the main reason for the non-uniformity of the grayscales in the self-luminous display is that threshold voltages of each pixel unit are non-uniform, and the threshold voltages drift along with the use of the pixel units, rendering the non-uniformity of the grayscales more worse. In the embodiment of the present disclosure, according to the characteristics that the relationship between the self-luminous display and the driving current and voltage when the pixel units of the self-luminous display are driven at a low voltage is not exactly consistent to that when the pixel units of the self-luminous display are driven at a high voltage, the driving function corresponding to the driving voltage value is determined according to the interval to which the driving voltage belongs. The driving functions corresponding to different driving voltages may be the same or different at the same time, and the driving functions corresponding to the same driving voltages may be the same or different at different times.

The number of intervals of the driving voltage may be two, three, five and the like, which is not limited in the present disclosure. For example, each driving voltage can be divided into different intervals according to the threshold voltage of the pixel units, the maximum sustainable voltage of the pixel units, and the like. For example, if the threshold voltage of the pixel units is 3.5 volts (V), the maximum sustainable driving voltage is 10V, and when the driving voltage is near 5V and 7V, the brightness of the OLED changes greatly, hence the interval for the driving voltage can be divided into four intervals: [0V, 3.5V], [3.5V, 5V], [5V, 7V], [7V, 10V], and each voltage interval corresponds to a compensation function.

The compensating apparatus may determine each preset driving function corresponding to each driving voltage value after obtaining each driving voltage value corresponding to each grayscale signal. In this embodiment, each preset driving function is a relational expression between driving voltages and driving currents in each corresponding interval. For example, the preset driving function is shown in formula (1):

$$I_{oled}=a*V_{data}^3+b*V_{data}^2+c*V_{data}+d \quad (1)$$

Where $I_{oled}$ is the driving current, $V_{data}$ is the driving voltage, a, b, c, d are proportion constants. Different intervals of the driving voltage correspond to different proportion constants.

Since the driving voltage and the driving current satisfy the relationship shown in formula (1), after each driving function corresponding to each driving voltage value is determined according to the intervals to which each driving voltage value belongs, each first driving current value corresponding to each driving voltage value, that is, each first driving current value corresponding to each grayscale signal, can be obtained according to each preset driving function.

S33, detecting each second driving current value of pixel units of the self-luminous display in case of being driven at each driving voltage value.

Figure 4:
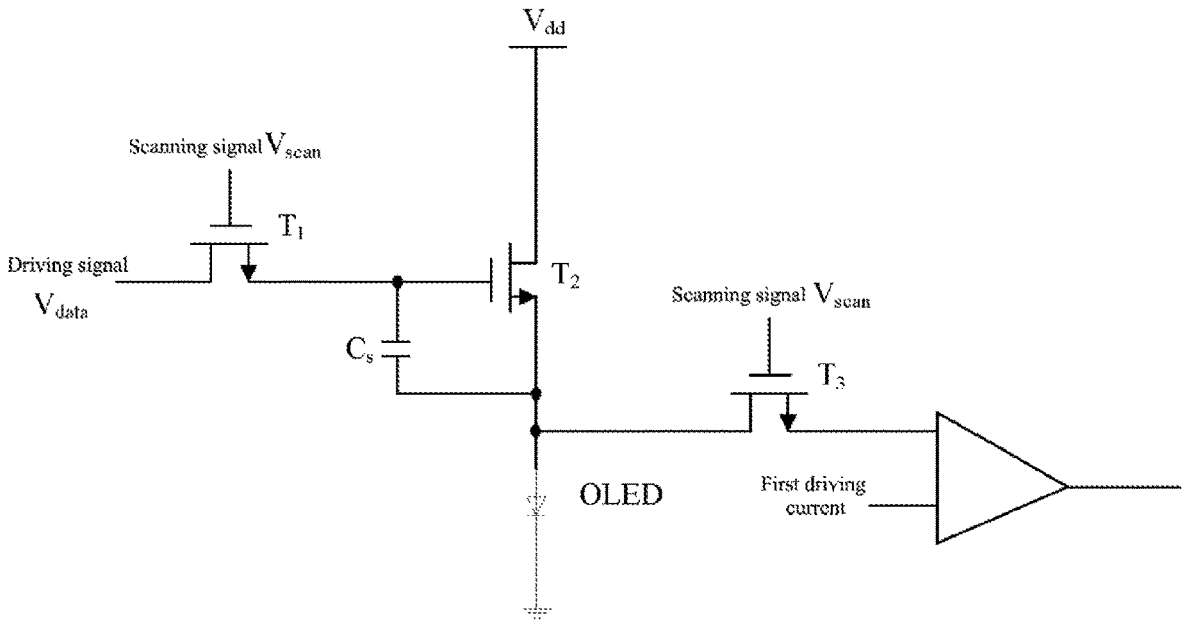
FIG. 4 is a schematic diagram of a detecting circuit for a driving current of pixel units.

A detecting circuit as shown in FIG. 4 may be used to detect each second driving current value of each pixel unit in the case of being driven at each driving voltage value. FIG. 4 is a schematic diagram of a detecting circuit for a driving current of a pixel unit. As shown in FIG. 4, $T_3$ is a detecting transistor, the drain of $T_3$ is connected to the source of the driving transistor $T_2$, the gate of $T_3$ is connected to the gate of $T_1$, when the row driving circuit outputs a scanning signal $V_{scan}$ and controls $T_3$ to be conductive at the same time, so that the current flowing through $T_2$ flows into the compensating apparatus through $T_3$ and is compared with each first driving current.

In the present disclosure, the process of obtaining the first driving current values corresponding to each grayscale signal in S31 and S32 and the process of obtaining the second driving current values corresponding to each grayscale signal in S33 may be performed at the same time or in sequence. For example, S31 and S32 may be performed first and then S33 is performed, or S33 may be executed first and then S31 and S32 are performed and so on, which is not limited in this embodiment. Therefore, the above performing orders are included in the protected solutions of the present disclosure.

S34, determining, according to each preset driving function, differences between each first driving current value and each second driving current value, each compensating voltage value corresponding to each grayscale signal.

If the compensating apparatus determines by comparison that the first driving current value is different from the second driving current value, it may determine that the driving threshold voltage values of the pixel units have drifted, and then determine each corresponding compensating voltage value (the drifting values of the driving threshold voltages) according to the corresponding driving functions, the differences between each first driving current value and each second driving current value. For example, if a 100 grayscale signal corresponds to a driving voltage of 5 volt (V), the first driving current determined according to a preset driving function is 1 ampere (A), and it is detected that the second driving current is 0.8 A, thus it can be determined that the driving threshold voltage value of the pixel unit has drifted. Therefore, if the compensated driving current is required to be 1 A, it can be determined, according to the driving function, how much driving voltage is needed to compensate the driving current of 0.2 A. Assuming that the driving voltage corresponding to the driving current of 0.2 A is X(V), it can then be determined that the 100 grayscale signal corresponds to the compensating voltage X(V). In this case, during the subsequent image display, the determined X(V) may be added into the 5V driving voltage to drive the pixel unit when the compensating apparatus receives the 100 grayscale signal, so as to overcome the non-uniformity defect of the grayscales caused by the $V_{th}$ drifting and other defects. In this embodiment, different compensating voltages are determined according to formula (1) for different grayscale signals, so that the uniformity of each grayscale can be improved.

Each compensating voltage corresponding to each determined grayscale signal may be stored in the compensating apparatus in the form of a mapping relationship table or may also be stored in the compensating apparatus in the form of a curve and so on, which is not limited in the present disclosure. When being used by the self-luminous display, the compensating apparatus queries the mapping relationship table and uses the compensating voltages corresponding to each grayscale signal to drive the pixel units along with the actual driving voltage.

Since the driving threshold voltage value keeps changing with the aging of the pixel unit, therefore, in this embodiment, according to the method provided in this embodiment, the compensating apparatus can determine the compensating voltages corresponding to each grayscale signal once at every preset time interval, for example, every 1 hour, 2 hours, 4 hours and the like, and update the compensating voltages corresponding to each grayscale signal once so that the self-luminous display apparatus compensates the driving voltage according to the updated compensating voltages.

According to the grayscale compensating method for the self-luminous display in the present disclosure, each driving voltage corresponding to each grayscale signal of a self-luminous display is obtained at first, and each preset driving function corresponding to each driving voltage is determined according to intervals to which each driving voltage belongs, then, first driving current values corresponding to each driving voltage are determined according to each preset driving function, the first driving currents are compared with each second driving current of pixel units detected in case of being driven at each driving voltage, and each compensating voltage corresponding to each grayscale signal is determined according to each driving function, the difference between each first driving current and each second driving current. The grayscale compensating method for the self-luminous display utilizes different driving functions for different grayscale signals to determine the compensating voltages according to different operating characteristics when the pixel units are driven by different driving voltages, so that the driving voltage of each grayscale can be better compensated, thereby better realizing brightness and chrominance uniformities of each grayscale of the self-luminous display.

It can be seen from the above analysis that the intervals of the driving voltage can be two, three, or five, and so on. Two driving voltage intervals are used as an example in the following to further describe the grayscale compensating method for the self-luminous display according to the present disclosure.

Figure 5:
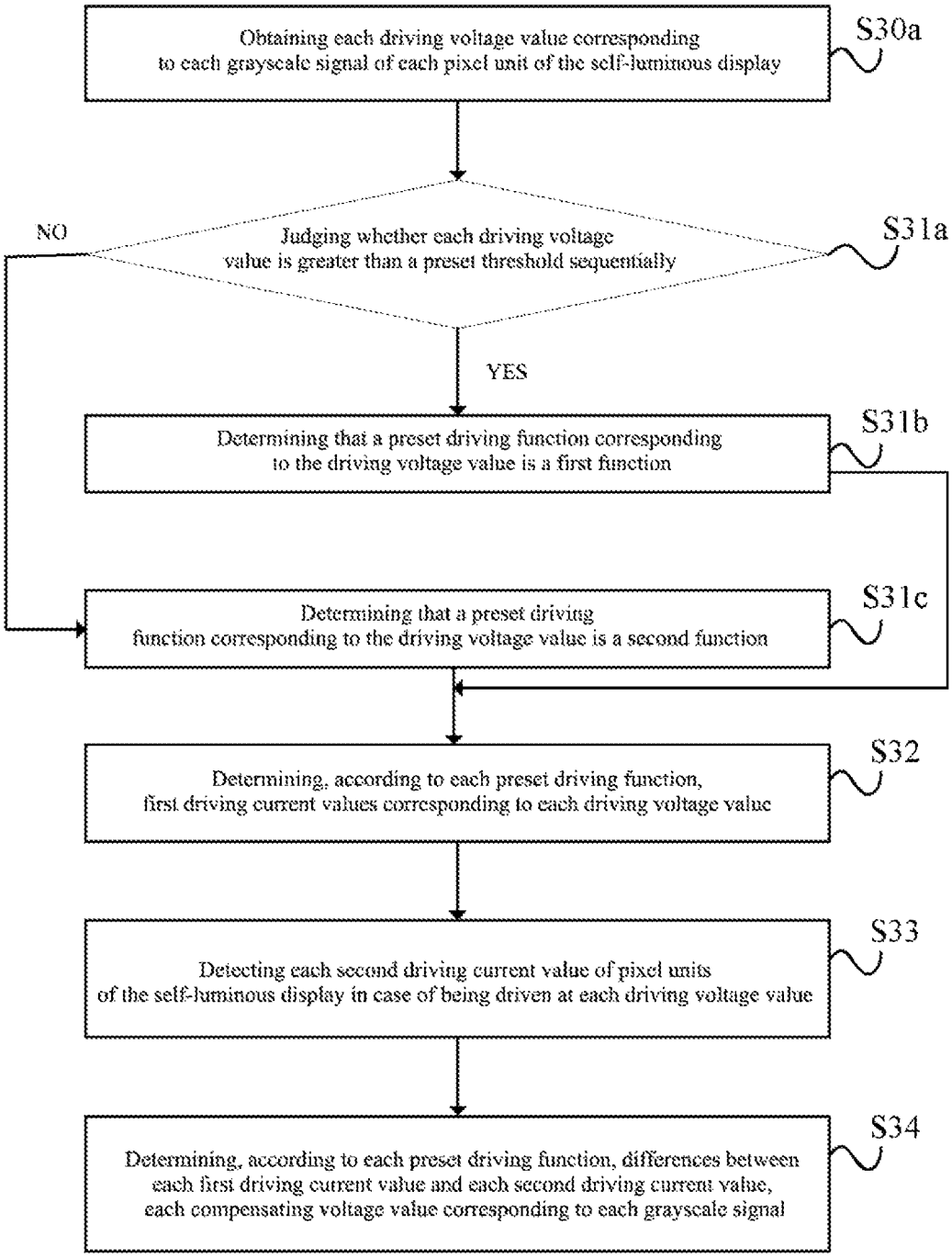
FIG. 5 is a schematic flow chart of another method for determining a compensating voltage provided according to some embodiments of the present disclosure.

FIG. 5 is a schematic flow chart of method for determining a compensating voltage provided according to a second embodiment of the present disclosure. As shown in FIG. 5, the above S31 specifically includes:

S31*a*, judging whether each driving voltage value is greater than a preset threshold sequentially, if yes, perform S31*b*, if not, perform S31*c*.

The preset threshold may be a threshold voltage of the pixel unit, for example, 5.2 v. When the preset threshold is the threshold voltage of the pixel unit, the driving voltage can be divided into two intervals, and each of the intervals corresponds to a preset driving function, take the second function being the preset driving function when the driving voltage is less than the threshold voltage and the first function being the preset driving function when the driving voltage is greater than the threshold voltage as an example, since the current of the self-luminous display device increases slowly when the driving voltage is less than the threshold voltage, that is, the change of the current is smaller with the same difference; when the driving voltage is greater than the threshold voltage, the current increases rapidly, that is, the change of the current is larger with the same difference. Therefore, compared with the related art using a single preset function, the present disclosure uses different preset driving functions for different voltage intervals according to the luminous characteristics of the self-luminous display device, so that each preset driving function can reflect the relationship between voltages and currents in each interval more accurately. However, a preset function used in the related art can not accurately reflect the relationship between voltages and currents in two intervals with different changing trends. Therefore, the compensating voltage obtained in this application is more accurate.

S31*b*: determining that a preset driving function corresponding to the driving voltage value is a first function.

S31*c*: determining that a preset driving function corresponding to the driving voltage value is a second function.

The first function can be: $I_{oled}=0.9848*V_{data}^3+37.502*V_{data}^2+V_{data}+670.63$; the second function can be: $I_{oled}=6.6*V_{data}^3-49.34*V_{data}^2+109.88*V_{data}-60.006$; where $I_{oled}$ is the driving current, and $V_{data}$ is the driving voltage.

In the present disclosure, each second driving current value corresponding to each grayscale signal of different pixel units can be detected to determine each compensation voltage of each grayscale signal of the self-luminous display according to preset driving functions. At this moment, the driving voltages of all the pixel units of the display can be compensated according to each determined voltage compensating value when the self-luminous display screen displays.

Considering the different usage conditions of different pixel units, the driving threshold voltages may also have different drift values, and each second driving current value corresponding to each grayscale signal of different pixel units may be detected to determine each compensating voltage corresponding to each grayscale signal of different pixel units, the above S30 includes:

S30*a*: obtaining each driving voltage value corresponding to each grayscale signal of each pixel unit of the self-luminous display.

Taking a self-luminous display with a 8 bit grayscale as an example, if 0 grayscale is considered, there are 256 grayscales correspondingly. If a self-luminous display includes N×M pixel units, with respect to the N×M pixel units, each pixel unit includes 256 corresponding relationships between grayscale signals and compensating voltages, that is, the self-luminous display includes N×M×256 corresponding relationships between grayscale signals and compensating voltages, and the N×M×256 compensating voltages may be sequentially stored in the compensating apparatus with the addresses of the pixel units as indexes. When a picture is displayed on the self-luminous display, the compensating apparatus looks up the corresponding grayscale signal and compensating voltage according to the address of the pixel unit corresponding to the grayscale signal, and then looks up the corresponding compensating voltage according to the grayscale signal. Thereafter, the compensating voltage drives the corresponding pixel unit together with the driving voltage determined according to the grayscale signal so that the picture is displayed. Since the voltage compensation is performed on each grayscale signal of each pixel unit, the uniformity of each grayscale of the self-luminous display is improved.

According to the grayscale compensating method for the self-luminous display in some embodiments of the present disclosure, each driving voltage value corresponding to each grayscale signal of each pixel unit of the self-luminous display is obtained, and then whether each driving voltage value is greater than a preset threshold is judged, if yes, it is determined that a preset driving function corresponding to the driving voltage value is a first function, if not, it is determined that a preset driving function corresponding to the driving voltage value is a second function, and each first driving current corresponding to each driving voltage is determined according to the first function or the second function, and the first driving current is compared with each detected second driving current of the pixel units driven at the driving voltages, and compensating voltages corresponding to each grayscale signal are determined according to the determined functions, the differences between the first driving currents and the second driving currents. The grayscale compensating method for the self-luminous display utilizes different driving functions for different grayscale signals of different pixel units to determine the compensating voltages according to different operating characteristics when the pixel units are driven at different driving voltages, so that the driving voltages of each grayscale of each pixel unit can be accurately compensated, thereby realizing better brightness and chrominance uniformity of each grayscale of the self-luminous display.

Figure 6:
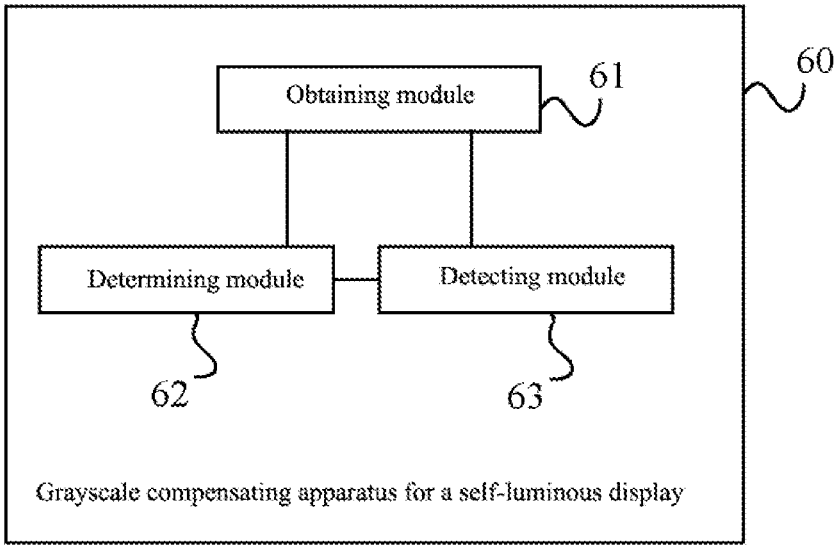
FIG. 6 is a schematic structural diagram of a grayscale compensating apparatus for a self-luminous display provided according to some embodiments of the present disclosure.

FIG. 6 is a schematic structural diagram of a grayscale compensating apparatus for a self-luminous display provided according to some embodiments of the present disclosure. As shown in FIG. 6, the apparatus 60 includes an obtaining module 61, a determining module 62, and a detecting module 63.

The obtaining module is configured to obtain each driving voltage value corresponding to each grayscale signal of the self-luminous display; a determination module is configured to determine each preset driving function corresponding to each driving voltage value according to intervals to which each driving voltage value belongs, where each preset driving function is the relational expression between driving voltages and driving currents in each corresponding interval; the determining module is further configured to determine first driving current values corresponding to each driving voltage value according to each preset driving function; a detecting module is configured to detect each second driving current value of pixel units of the self-luminous display in case of being driven at each driving voltage value; and the determining module is further configured to determine each compensating voltage value corresponding to each grayscale signal according to each driving function, differences between each first driving current value and each second driving current value.

The executive subject matter of the grayscale compensating method for the self-luminous display is a grayscale compensating apparatus for the self-luminous display, which is simply referred to as a compensating apparatus collectively hereinafter. In this embodiment, the compensating apparatus may be arranged between the television core and the Tcon, and may also be arranged between the Tcon and the driving circuit, and may also be integrated in the Tcon or the driving circuit, which is not limited herein. In the present disclosure, the compensation apparatus which is integrated in the Tcon will be described as an example.

The driving voltage in the embodiment of the present disclosure is a data signal $V_{data}$ on a data line in the driving circuit of the pixel units, that is, the driving voltage corresponding to the grayscale signal of the pixel unit.

In terms of the pixel units of the self-luminous display, in an ideal state, different gray-scale signals correspond to different driving voltages. In this embodiment, a mapping relationship table between grayscale signals and driving voltages may be pre-stored in the compensating apparatus. After obtaining each grayscale signal, the compensating apparatus determines each driving voltage value corresponding to each grayscale signal by looking up the mapping relationship table between grayscale signals and driving voltages. Alternatively, the mapping relationship table between grayscale signals and driving voltages may also be stored in the Tcon. After receiving each grayscale signal, the Tcon determines each driving voltage corresponding to each grayscale signal by looking up the mapping relationship table between grayscale signals and driving voltages, and sends each driving voltage value to the compensating apparatus. The present disclosure does not limit this.

It can be understood that the corresponding relationship between grayscale signals and driving voltages can be stored in the compensating apparatus or the Tcon in the form of a curve in addition to in the form of a mapping table as described above. If the compensating apparatus or the Tcon stores a curve of grayscale signals and driving voltages, in the process of the image display, the compensating apparatus or the Tcon can determine the driving voltages corresponding to different grayscale signals by looking up the curve.

The driving functions corresponding to different driving voltages may be the same or different at the same time, and the driving functions corresponding to the same driving voltages may be the same or different at different times.

The number of intervals of the driving voltage may be two, three, five and the like, which is not limited in the present disclosure. For example, each driving voltage can be divided into different intervals according to the threshold voltage of the pixel units, the maximum sustainable voltage of the pixel units, and the like. For example, if the threshold voltage of the pixel units is 3.5 volts (V), the maximum sustainable driving voltage is 10V, and when the driving voltage is near 5V and 7V, the brightness of the OLED changes greatly, hence the interval for the driving voltage can be divided into four intervals: [0V, 3.5V], [3.5V, 5V], [5V, 7V], [7V, 10V], and each voltage interval corresponds to a compensation function.

The compensating apparatus may determine each preset driving function corresponding to each driving voltage value after obtaining each driving voltage value corresponding to each grayscale signal. In some embodiment, each preset driving function is a relational expression between driving voltages and driving currents in each corresponding interval. For example, the preset driving function can be as shown in formula (1):

$$I_{oled}=a*V_{data}^3+b*V_{data}^2+c*V_{data}+d \quad (1)$$

Where $I_{oled}$ is the driving current, $V_{data}$ is the driving voltage, a, b, c, d are proportion constants. Different intervals of the driving voltage correspond to different proportion constants.

Since the driving voltage and the driving current satisfy the relationship shown in formula (1), after each driving function corresponding to each driving voltage value is determined according to the intervals to which each driving voltage value belongs, each first driving current value corresponding to each driving voltage value, that is, each first driving current value corresponding to each grayscale signal, can be obtained according to each preset driving function. For example, the detecting module in this embodiment can be implemented by using the detection circuit shown in FIG. 4, so as to detect each second driving current value corresponding to each grayscale signal. As shown in FIG. 4, $T_3$ is a detecting transistor, the drain of $T_3$ is connected to the source of the driving transistor $T_2$, the gate of $T_3$ is connected to the gate of $T_1$, when the row driving circuit outputs a scanning signal $V_{scan}$ and controls $T_3$ to be conductive at the same time, so that the current flowing through $T_2$ flows into the compensating apparatus through $T_3$ and the compensating apparatus obtains each second driving current value corresponding to each grayscale signal. Afterwards, if the compensating apparatus determines by comparison that the first driving current value is different from the second driving current value, it may determine that the driving threshold voltage values of the pixel units have drifted, and then determine each compensating voltage value corresponding to each grayscale signal (the drifting values of the driving threshold voltages) according to the corresponding driving functions, the differences between each first driving current value and the second driving current value. For example, if a 100 grayscale signal corresponds to a driving voltage of 5 volt (V), the first driving current determined according to a preset driving function is 1 ampere (A), and it is detected that the second driving current is 0.8 A, thus it can be determined that the driving threshold voltage value of the pixel unit has drifted. Therefore, if the compensated driving current is required to be 1 A, it can be determined, according to the driving function, how much driving voltage is needed to compensate the driving current of 0.2 A. Assuming that the driving voltage corresponding to the driving current of 0.2 A is X(V), it can then be determined that the 100 grayscale signal corresponds to the compensating voltage X(V). In this case, during the subsequent image display, the determined X(V) may be added into the 5V driving voltage to drive the pixel unit when the compensating apparatus receives the 100 grayscale signal, so as to overcome the non-uniformity defect of the grayscales caused by the $V_{th}$ drifting and other defects. In the present disclosure, different compensating voltages are determined according to formula (1) for different grayscale signals, so that the uniformity of each grayscale can be improved.

Each compensating voltage corresponding to each determined grayscale signal may be stored in the compensating apparatus in the form of a mapping relationship table or may also be stored in the compensating apparatus in the form of a curve and so on, which is not limited in the present disclosure. When being used by the self-luminous display, the compensating apparatus queries the mapping relationship table and uses the compensating voltages corresponding to each grayscale signal to drive the pixel units along with the actual driving voltage.

Since the driving threshold voltage value keeps changing with the aging of the pixel unit, therefore, in this embodiment, according to the method provided in this embodiment, the compensating apparatus can determine the compensating voltages corresponding to each grayscale signal once at every preset time interval, for example, every 1 hour, 2 hours, 4 hours and the like, and update the compensating voltages corresponding to each grayscale signal once so that the self-luminous display apparatus compensates the driving voltage according to the updated compensating voltages.

According to the grayscale compensating apparatus for the self-luminous display provided in the present disclosure, each driving voltage corresponding to each grayscale signal of a self-luminous display is obtained at first, and each preset driving function corresponding to each driving voltage is determined according to intervals to which each driving voltage belongs, then, first driving current values corresponding to each driving voltage are determined according to each preset driving function, the first driving currents are compared with each second driving current of pixel units detected in case of being driven at each driving voltage, and each compensating voltage corresponding to each grayscale signal is determined according to each driving function, the difference between each first driving current and each second driving current. The grayscale compensating method for the self-luminous display utilizes different driving functions for different grayscale signals to determine the compensating voltages according to different operating characteristics when the pixel units are driven by different driving voltages, so that the driving voltage of each grayscale can be better compensated, thereby better realizing brightness and chrominance uniformities of each grayscale of the self-luminous display.

Figure 7:
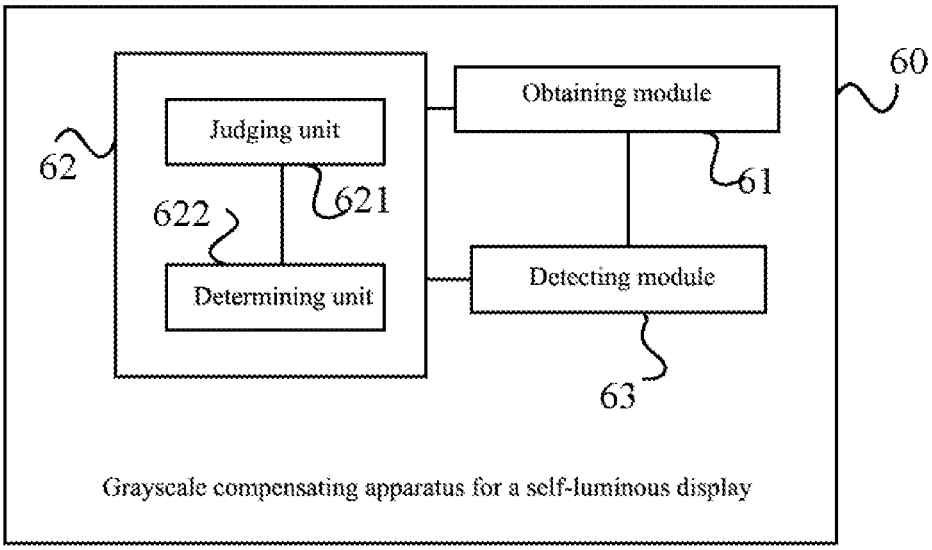
FIG. 7 is a schematic structural diagram of another grayscale compensating apparatus for a self-luminous display provided according to some embodiments of the present disclosure.

It can be seen from the above analysis that the intervals of the driving voltage can be two, three, or five, and so on. Two driving voltage intervals are used as an example in the following to further describe the grayscale compensating apparatus for the self-luminous display according to the present disclosure. FIG. 7 is a schematic structural diagram of another grayscale compensating apparatus for the self-luminous display provided according to some embodiments of the present disclosure.

As shown in FIG. 7, the aforementioned determining module 62 includes:

a judging unit 621, configured to judging whether each driving voltage value is greater than a preset threshold sequentially; a determining unit 622, configured to determine, if yes, that a preset driving function corresponding to the driving voltage value is a first function.

The preset threshold may be a threshold voltage of the pixel unit, for example, 5.2 v.

The determining unit 622 is further configured to determine, if not, that a preset driving function corresponding to the driving voltage value is a second function.

The first function can be: $I_{oled}=0.9848*V_{data}^3+37.052*V_{data}^2+V_{data}+670.63$; the second function can be:

$I_{oled}=6.6*V_{data}^3-49.34*V_{data}^2+109.88*V_{data}-60.006$;
where $I_{oled}$ is the driving current, and $V_{data}$ is the driving voltage.

In the present disclosure, each second driving current value corresponding to each grayscale signal of different pixel units can be detected to determine each compensation voltage of each grayscale signal of the self-luminous display according to preset driving functions. At this moment, the driving voltages of all the pixel units of the display can be compensated according to each determined voltage compensating value when the self-luminous display screen displays.

Considering the different usage conditions of different pixel units, the driving threshold voltages may also have different drift values, and each second driving current value corresponding to each grayscale signal of different pixel units may be detected to determine each compensating voltage corresponding to each grayscale signal of different pixel units, the obtaining module is configured to: obtaining each driving voltage value corresponding to each grayscale signal of each pixel unit of the self-luminous display.

For example, taking a self-luminous display with a 8 bit grayscale as an example, if 0 grayscale is considered, there are 256 grayscales correspondingly. If a self-luminous display includes N×M pixel units, with respect to the N×M pixel units, each pixel unit includes 256 corresponding relationships between grayscale signals and compensating voltages, that is, the self-luminous display includes N×M×256 corresponding relationships between grayscale signals and compensating voltages, and the N×M×256 compensating voltages may be sequentially stored in the compensating apparatus with the addresses of the pixel units as indexes. When a picture is displayed on the self-luminous display, the compensating apparatus looks up the corresponding grayscale signal and compensating voltage according to the address of the pixel unit corresponding to the grayscale signal, and then looks up the corresponding compensating voltage according to the grayscale signal. Thereafter, the compensating voltage drives the corresponding pixel unit together with the driving voltage determined according to the grayscale signal so that the picture is displayed. Since the voltage compensation is performed on each grayscale signal of each pixel unit, the uniformity of each grayscale of the self-luminous display is improved.

According to the grayscale compensating method for the self-luminous display in the embodiment of the present disclosure, each driving voltage value corresponding to each grayscale signal of each pixel unit of the self-luminous display is obtained, and then whether each driving voltage value is greater than a preset threshold is judged, if yes, it is determined that a preset driving function corresponding to the driving voltage value is a first function, if not, it is determined that a preset driving function corresponding to the driving voltage value is a second function, and each first driving current corresponding to each driving voltage is determined according to the first function or the second function, and the first driving current is compared with each detected second driving current of the pixel units driven at the driving voltages, and compensating voltages corresponding to each grayscale signal of each pixel unit are determined according to the determined functions, the differences between the first driving currents and the second driving currents. The grayscale compensating method for the self-luminous display utilizes different driving functions for different grayscale signals of each pixel unit to determine the compensating voltages according to different operating characteristics when the pixel units are driven at different driving voltages, so that the driving voltages of each grayscale of each pixel unit can be accurately compensated, thereby realizing better brightness and chrominance uniformity of each grayscale of the self-luminous display.

Figure 8:
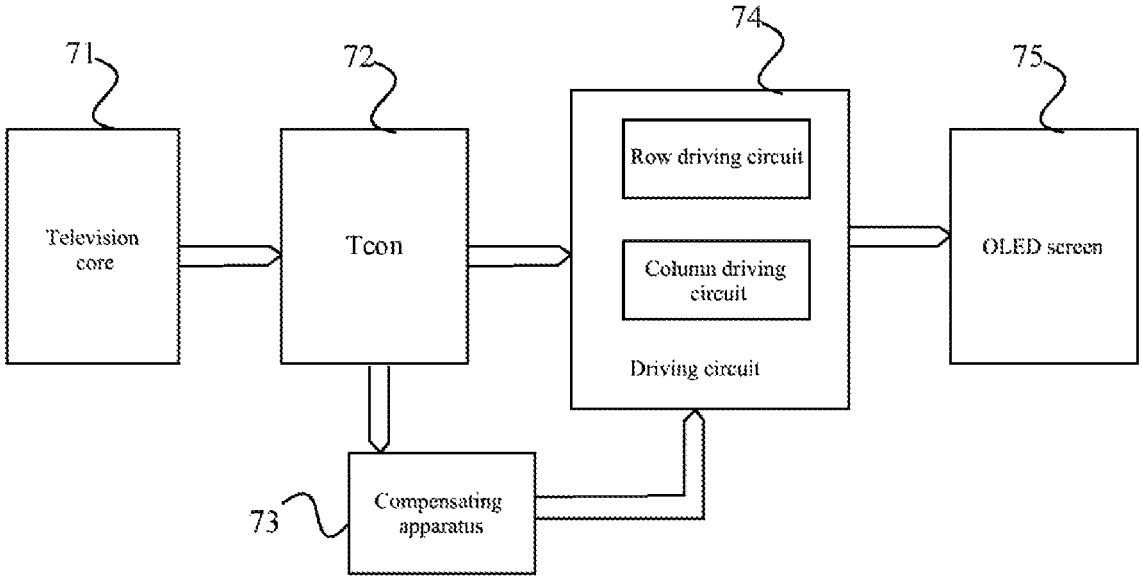
FIG. 8 is a schematic structural diagram of a self-luminous display provided according to some embodiments of the present disclosure.

FIG. 8 is a schematic structural diagram of a self-luminous display provided according to some embodiments of the present disclosure. As shown in FIG. 8, the self-luminous display device includes a television core 71, a time controller (Tcon) 72, a compensating apparatus 73, a driving circuit 74 and an OLED screen 75.

The compensating apparatus is the grayscale compensating apparatus for the self-luminous display described in the above embodiments. For the structure and functions of each part of the compensating apparatus, reference may be made to the detailed description of each embodiment of the grayscale compensating method provided in the foregoing embodiments, and details are not repeated herein again.

In the self-luminous display device provided by the present embodiment, each grayscale of each pixel unit of the self-luminous display can be well compensated by adopting the above-mentioned grayscale compensation so as to improve the brightness and chrominance uniformity of each grayscale of the self-luminous display, and thus improving the user experience.

It should be understood by those skilled in the art that all or a part of the steps for implementing the foregoing method embodiments may be implemented by a program instructing relevant hardware. The foregoing program may be stored in a computer-readable storage medium, and when the program is executed, the method includes the steps of the foregoing method embodiments, and the foregoing storage medium includes various media capable of storing program codes, such as a ROM, a RAM, a magnetic disk, or an optical disk.

Finally, the foregoing embodiments are merely provided for describing the technical solutions of the present disclosure, but not for limiting the present disclosure. Although the present disclosure has been described in detail with reference to the foregoing embodiments, those skilled in the art should understand that the technical solutions described in the foregoing embodiments may still be modified or equivalent replacements may be made to some or all of the technical features in the embodiments. These modifications or replacements do not make the essence of the corresponding technical solutions depart from the scope of the technical solutions of the embodiments of the present disclosure.

What is claimed is:

1. A grayscale compensating method for a self-luminous display, comprising:

obtaining each driving voltage value corresponding to each grayscale signal of a self-luminous display;

determining, according to intervals to which each driving voltage value belongs, each preset driving function corresponding to each driving voltage value, wherein each preset driving function is a relational expression between driving voltages and driving currents in each corresponding interval;

determining, according to each preset driving function, first driving current values corresponding to each driving voltage value;

detecting each second driving current value of pixel units of the self-luminous display in case of being driven at each driving voltage value;

determining, according to each driving function, differences between each first driving current value and each second driving current value, each compensating voltage value corresponding to each grayscale signal;

wherein the determining, according to intervals to which each driving voltage value belongs, each preset driving function corresponding to each driving voltage value comprises:

judging whether each driving voltage value is greater than a preset threshold sequentially;

determining, if yes, that a preset driving function corresponding to the driving voltage value is a first function; and determining, if not, that a preset driving function corresponding to the driving voltage value is a second function;

wherein the first function is: $I_{oled}=0.9848*V_{data}^3+37.502*V_{data}^2+V_{data}+670.63$, the second function is: $I_{oled}=6.6*V_{data}^3-49.34*V_{data}^2+109.88*V_{data}-60.006$, wherein $I_{oled}$ is a driving current and $V_{data}$ is a driving voltage.

2. The method according to claim 1, wherein the preset threshold is a threshold voltage of the pixel units of the self-luminous display.

3. The method according to claim 1, wherein the obtaining each driving voltage value corresponding to each grayscale signal of the self-luminous display comprises:

obtaining each driving voltage value corresponding to each grayscale signal of each pixel unit of the self-luminous display.

* * * * *